US011079694B2

(12) United States Patent
Miyajima et al.

(10) Patent No.: US 11,079,694 B2
(45) Date of Patent: Aug. 3, 2021

(54) TONER FOR DEVELOPING ELECTROSTATIC CHARGE IMAGE

(71) Applicant: Konica Minolta, Inc., Tokyo (JP)

(72) Inventors: Kenshi Miyajima, Hino (JP); Shinya Obara, Fuchu (JP); Ikuko Sakurada, Hachioji (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 16/793,401

(22) Filed: Feb. 18, 2020

(65) Prior Publication Data

US 2020/0292952 A1 Sep. 17, 2020

(30) Foreign Application Priority Data

Mar. 11, 2019 (JP) ..... JP2019-043296

(51) Int. Cl.
*G03G 9/08* (2006.01)
*G03G 9/087* (2006.01)
*G03G 9/097* (2006.01)

(52) U.S. Cl.
CPC ..... *G03G 9/08755* (2013.01); *G03G 9/09708* (2013.01); *G03G 9/09725* (2013.01)

(58) Field of Classification Search
CPC ..... G03G 9/08755; G03G 9/09725; G03G 9/09708
USPC ..... 430/109.4, 108.6, 108.7
See application file for complete search history.

(56) References Cited

U.S. PATENT DOCUMENTS

| | | | | |
|---|---|---|---|---|
| 8,153,343 | B2 * | 4/2012 | Kubo | G03G 9/09708 430/108.6 |
| 2003/0073018 | A1 * | 4/2003 | Tachi | G03G 9/08755 430/108.6 |
| 2005/0260515 | A1 * | 11/2005 | Kato | G03G 9/0827 430/108.6 |
| 2015/0037722 | A1 * | 2/2015 | Yamazaki | G03G 9/08791 430/108.4 |
| 2020/0285162 | A1 * | 9/2020 | Mine | G03G 9/0821 |

FOREIGN PATENT DOCUMENTS

| | | |
|---|---|---|
| JP | 2009-162957 A | 7/2009 |
| JP | 2012-123196 A | 6/2012 |

* cited by examiner

*Primary Examiner* — Mark A Chapman
(74) *Attorney, Agent, or Firm* — Lucas & Mercanti, LLP

(57) ABSTRACT

A toner for electrostatic charge image development is a toner for electrostatic charge image development including toner particles containing a binder resin and an external additive, wherein the binder resin contains a crystalline polyester resin and an amorphous polyester resin, the external additive includes Al—Si composite oxide particles, and a Si element content of the Al—Si composite oxide particles is in the range of 50 to 90 mass % and a Si element ratio on surfaces of the Al—Si composite oxide particles is in the range of 3 to 35 at %.

6 Claims, No Drawings

TONER FOR DEVELOPING ELECTROSTATIC CHARGE IMAGE

CROSS-REFERENCE TO RELATED APPLICATIONS

The entire disclosure of Japanese Patent Application No. 2019-043296 filed on Mar. 11, 2019 is incorporated herein by reference in its entirety.

BACKGROUND

Technological Field

The present invention relates to a toner for electrostatic charge image development. More specifically, the present invention relates to a toner for electrostatic charge image development, which is excellent in low-temperature fixability and with which images can be stably output even in various printing environments and a low printing mode.

Description of the Related Art

In recent years, from the viewpoint of high-speed printing and energy saving, a toner for electrostatic charge image development (hereinafter, also simply referred to as "toner") that can be fixed at a lower temperature than before has been required. In order to lower the fixing temperature of the toner, it is necessary to lower the melt viscosity of the binder resin in the toner. In order to reduce the melt viscosity of the toner, a toner containing a crystalline polyester resin has been proposed (for example, see JP 2009-162957A). Crystalline polyester resins, which have a property of melting quickly at a temperature equal to or higher than the melting point, are advantageous in lowering the fixing temperature of the toner.

Further, in order to improve the anti-crease performance of the toner image after fixing, a toner containing an amorphous polyester resin is useful. This is because amorphous polyester resins are highly polar and have high internal cohesion.

Meanwhile, it is known that the fluidity of toner particles is improved by externally adding inorganic fine particles as external additives to the surface of toner particles for the purpose of improving image quality. However, the toner containing a crystalline polyester resin has characteristics that the electric resistance under high-temperature and high-humidity tends to be low and the surface of the toner is relatively soft. Thus, when silica, titania or alumina particles are externally added alone, in the case of silica, a decrease in image density occurs in a low-temperature and low-humidity environment, in the case of alumina, a decrease in image density occurs in low printing modes due to the embedding of external additive, and in the case of titania, image defects such as fogging on non-printed portion occurs in a high-temperature and high-humidity environment. For this reason, a method of externally adding mixed oxide particles of Al and Si having relatively good compatibility has been proposed (see JP 2012-123196A).

However, in the method of externally adding the mixed oxide particles of Al and Si, the composition ratio of the bulk of the external additive is controlled, but the surface composition is not controlled. That is, the control of the surface resistance has not been performed.

For this reason, stabilization of images obtained under various printing environments such as high-temperature and high-humidity and low-temperature and low-humidity, or in a low printing mode is not sufficient, and improvement has been demanded.

SUMMARY

The present invention has been made in view of the above problems, conditions, and an object of the present invention is to provide a toner for electrostatic charge image development which is excellent in low-temperature fixability and can stably form a high-quality image in a high-temperature and high-humidity or low-temperature and low-humidity environment or during a low printing mode.

A toner for electrostatic charge image development according to one aspect of the present invention to achieve the above object is a toner for electrostatic charge image development including toner particles containing a binder resin and an external additive, in which the binder resin contains a crystalline polyester resin and an amorphous polyester resin, the external additive includes Al—Si composite oxide particles, and a Si element content of the Al—Si composite oxide particles is in the range of 50 to 90 mass % and a Si element ratio on surfaces of the Al—Si composite oxide particles is in the range of 3 to 35 at %.

DETAILED DESCRIPTION OF THE EMBODIMENTS

Hereinafter, one or more embodiments of the present invention will be described. However, the scope of the invention is not limited to the disclosed embodiments.

A toner for electrostatic charge image development according to the present invention is a toner for electrostatic charge image development including toner particles containing a binder resin and an external additive, in which the binder resin contains a crystalline polyester resin and an amorphous polyester resin, the external additive includes Al—Si composite oxide particles, a Si element content of the Al—Si composite oxide particles is in the range of 50 to 90 mass % and a Si element ratio on surfaces of the Al—Si composite oxide particles is in the range of 3 to 35 at %. This feature is a technical feature common to or corresponding to each of the following embodiments (aspects).

The above-described means of the present invention allows providing a toner for electrostatic charge image development which is excellent in low-temperature fixability and can stably form a high-quality image in a high-temperature and high-humidity or low-temperature and low-humidity environment or during a low printing mode. In particular, it is possible to provide a toner for electrostatic charge image development which is excellent in suppression of a decrease in image density and in-plane uniformity of image density under a low-temperature and low-humidity environment, suppression of toner fogging on non-printing portion under a high-temperature and high-humidity environment, and suppression of a decrease in image density in a low printing mode.

Although the mechanism of expression or action of the effects of the present invention has not been clarified, it is presumed as follows.

The use of silica as an external additive is effective in improving the fluidity of toner particles, but silica has a very high negative chargeability, is easily charged excessively, and thus increases the electrostatic adhesion between the toner containing an amorphous polyester resin also having a high negative chargeability and the carrier. Thus, the separability of the toner from the carrier is deteriorated under a low-temperature and low-humidity environment, causing image defects such as a decrease in image density to be likely to occur.

Therefore, by using titania having low electric resistance as an external additive, it is possible to suppress excessive charging in a low-temperature and low-humidity environment. However, when titania is used for the toner containing a crystalline polyester resin, the electric resistance of the toner under a high-temperature and high-humidity environment becomes too low, holding the charge becomes difficult for the toner, the charge quantity thereof is reduced, and thus image defects such as fogging on non-printed portion occurs.

When alumina particles are used, the negative chargeability thereof is lower than that of silica particles, and the electric resistance thereof is higher than that of titania particles. Therefore, the alumina particles are less likely excessively charged and also have excellent charge holding ability. However, alumina has a high Mohs hardness, and when alumina is used for the toner containing a crystalline polyester resin with a relatively soft surface, the alumina is embedded inside the toner during printing in the low printing rate mode and decreases the fluidity of the toner particles, so that a decrease in density occurs due to insufficient supply of the toner.

In order to solve this problem, a known example using composite oxide particles of an Al element and a Si element as an external additive (see Patent Literature 2) is known. In this known example, although not described in the text, the Si element ratio in the surface composition is considered to be 51 to 91 at % from the composition ratio, indicating that the Si element ratio is very high, and the excessive charging caused by the Si element is not sufficiently suppressed.

According to the present invention, the Si element ratio on the surface of the Al—Si composite oxide particles is controlled to be low so as to suppress the excessive charging caused by the Si element, and the Si element ratio in the Al—Si composite oxide particles is controlled so as to suppress embedding of the external additive caused by the Al element, and thus it is possible to provide a toner capable of being fixed at a low temperature and stably forming a high-quality image in a low printing mode and under high-temperature and high-humidity and low-temperature and low-humidity environments.

As an embodiment of the present invention, the Si element ratio on the surfaces of the Al—Si composite oxide particles is preferably in the range of 5 to 15 at % from the viewpoint of suppressing excessive charging caused by Si.

In addition, the Si element content of the Al—Si composite oxide particles is preferably in the range of 60 to 80 mass % from the viewpoint of improving the fluidity of the toner particles.

Further, in the present invention, the content of the crystalline polyester resin in the binder resin is preferably in the range of 5 to 20 mass %, from the viewpoint of the low-temperature fixability and suppressing a decrease in image density in the low printing mode.

As an embodiment of the present invention, the content of the amorphous polyester resin in the binder resin is preferably in the range of 30 to 80 mass % from the viewpoint of anti-crease performance and suppressing a decrease in image density under low-temperature and low-humidity.

«Toner for Electrostatic Charge Image Development»

A toner for electrostatic charge image development according to the present invention is a toner for electrostatic charge image development including toner particles containing a binder resin and an external additive, in which the binder resin contains a crystalline polyester resin and an amorphous polyester resin, the external additive includes Al—Si composite oxide particles, the Si element content of the Al—Si composite oxide particles is in the range of 50 to 90 mass %, and the Si element ratio on the surfaces of the Al—Si composite oxide particles is in the range of 3 to 35 at %.

As described above, the binder resin contains a crystalline polyester resin and an amorphous polyester resin, and using the Al—Si composite oxide particles as an external additive, the Si element ratio on the surfaces of the particles is controlled to be in a specific range. Within this range, excessive charging caused by Si can be suppressed, and by controlling the Si—Al element ratio of the external additive particles, a decrease in density can be suppressed even during printing in the low printing mode.

In the present invention, "toner" refers to an aggregate of "toner particles." Further, the toner particles contain at least toner base particles, and the toner particles refer to particles in which at least an external additive is added to the toner base particles.

«Toner Base Particles»

The toner base particles according to the present invention contain a binder resin, and optionally contain another component such as a colorant, a release agent (wax), and a charge control agent as necessary.

[Binder Resin]

The toner particles according to the present invention contain a crystalline polyester resin and an amorphous polyester resin.

The content of the crystalline polyester resin is preferably in the range of 5 to 20 mass %. When the content of the crystalline polyester resin is 5 mass % or more based on the binder resin, the melt viscosity of the toner can be more sufficiently lowered, and the low-temperature fixability becomes better.

The content of the crystalline polyester resin is preferably 20 mass % or less in view that within the range, the surface of the toner does not become soft, the embedding of the Al—Si composite oxide particles as external additive described later can be suppressed in the low printing mode, and the image density becomes better.

The content of the amorphous polyester resin is preferably in the range of 30 to 80 mass % based on the binder resin. When the content of the amorphous polyester resin is 30 mass % or more, sufficient internal cohesion of the resin is obtained, and the anti-crease performance of the toner image after fixing becomes better. Further, when the content of the amorphous polyester resin is 80 mass % or less, because the polarity of the resin does not become too high, the chargeability of the toner becomes appropriate under low-temperature and low-humidity, and thus the image density becomes better, which is preferable.

<Crystalline Polyester Resin>

The crystalline polyester resin is a polyester resin formed from a polyhydric alcohol and a polycarboxylic acid, and has a distinct melting point when measured by differential scanning calorimetry (DSC).

It is preferable that the toner base particles contain a crystalline polyester resin because the flexibility of the toner base particles is improved and the external additive is easily attached appropriately, and also preferable from the viewpoint of low-temperature fixability.

In the present invention, the crystalline polyester resin refers to a resin having a distinct endothermic peak, not a stepwise endothermic change in differential scanning calorimetry (DSC). The distinct endothermic peak specifically means a peak having a half-value width of an endothermic peak within 15° C. as measured at a heating rate of 10° C./min in differential scanning calorimetry (DSC).

The melting point Tmc of the crystalline resin is preferably 60° C. or higher from the viewpoint of obtaining sufficient high-temperature storability, and is preferably 85° C. or lower from the viewpoint of obtaining sufficient low-temperature fixability.

The melting point Tmc of the crystalline resin may be measured by DSC. Specifically, 0.5 mg of a crystalline resin sample is sealed in an aluminum pan "KITNO.B0143013," set in a sample holder of a thermal analyzer "Diamond DSC" (manufactured by PerkinElmer), and the temperature is varied in the order of heating, cooling, and heating. During the first and second heating, the temperature is raised from 0° C. to 150° C. at a heating rate of 10° C./min and held at 150° C. for 5 minutes, at the time of cooling, the temperature is reduced from 150° C. to 0° C. at a cooling rate of 10° C./min, and the temperature of 0° C. is held for 5 minutes. The temperature at the peak top of the endothermic peak in the endothermic curve obtained at the time of the second heating is measured as the melting point (Tmc) of the crystalline resin.

Further, the weight average molecular weight (Mw) of the crystalline polyester resin is preferably in the range of 5000 to 30000, and more preferably in the range of 8000 to 20000. Within these ranges, the fixed image has a sufficient strength, the crystalline resin is not pulverized during the stirring of the developing agent, the glass transition temperature Tg of the toner does not decrease due to the excessive plasticization effect, and the thermal stability of the toner is not lowered. In addition, sharp melt properties are exhibited, and low-temperature fixing becomes possible.

The weight average molecular weight (Mw) of the resin may be determined from the molecular weight distribution measured by gel permeation chromatography (GPC) as described later.

The crystalline polyester resin according to the present invention is obtained by a polycondensation reaction between a di- or higher valent carboxylic acid (polycarboxylic acid) and a di- or higher valent alcohol (polyhydric alcohol). As the crystalline polyester resin, a crystalline polyester resin known in the related art in the technological field may be used. Examples of the polycarboxylic acids and polyhydric alcohols used for preparing the crystalline polyester resin include the following.

(Polycarboxylic Acid)

Examples of the polycarboxylic acid component include aliphatic dicarboxylic acids such as oxalic acid, succinic acid, glutaric acid, adipic acid, suberic acid, azelaic acid, sebacic acid, 1,9-nonanedicarboxylic acid, 1,10-decanedicarboxylic acid, 1,12-dodecanedicarboxylic acid, 1,14-tetradecanedicarboxylic acid, and 1,18-octadecanedicarboxylic acid, and aromatic dicarboxylic acids such as dibasic acids such as phthalic acid, isophthalic acid, terephthalic acid, naphthalene-2,6-dicarboxylic acid, malonic acid, and mesaconic acid, and further include anhydrides and lower alkyl esters thereof, but not limited thereto.

Examples of the tri- or higher valent carboxylic acid include 1,2,3-benzenetricarboxylic acid, 1,2,4-benzenetricarboxylic acid, 1,3,5-benzenetricarboxylic acid, 1,2,4-naphthalenetricarboxylic acid, and anhydrides and lower alkyl esters thereof. These may be used singly or in combinations of two or more.

The content of the structural units derived from the aliphatic dicarboxylic acid based on the structural units derived from the dicarboxylic acid in the crystalline polyester resin is preferably 50 mol % or more from the viewpoint of sufficiently ensuring the crystallinity of the crystalline polyester, more preferably 70 mol % or more, still more preferably 80 mol % or more, and particularly preferably 100 mol % or more.

(Polyhydric Alcohol)

Specific examples of the aliphatic diol suitably used for the synthesis of the crystalline polyester include, but are not limited to, ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, and 1,14-eicosandecanediol. Of these, 1,6-hexanediol, 1,8-octanediol, 1,9-nonanediol, and 1,10-decanediol are preferred in view of availability.

Examples of the tri- or higher valent alcohol include glycerin, trimethylolethane, trimethylolpropane, and pentaerythritol. These may be used singly or in combinations of two or more.

The ratio of the diol and the dicarboxylic acid in the monomer of the crystalline polyester resin is preferably in the range of 2.0/1.0 to 1.0/2.0, more preferably in the range of 1.5/1.0 to 1.0/1.5, and particularly preferably in the range of 1.3/1.0 to 1.0/1.3 in terms of the equivalent ratio [OH]/[COOH] between the hydroxy group [OH] of the diol and the carboxy group [COOH] of the dicarboxylic acid.

The monomer constituting the crystalline polyester resin preferably contains a linear aliphatic monomer in an amount of 50 mass % or more, and more preferably 80 mass % or more. When an aromatic monomer is used, the melting point of the crystalline polyester resin tends to be high, and when a branched aliphatic monomer is used, the crystallinity tends to be low. Therefore, it is preferable to use a linear aliphatic monomer as the above monomer.

From the viewpoint of maintaining the crystallinity of the crystalline polyester resin in the toner, the linear aliphatic monomer is preferably used in an amount of 50 mass % or more, and more preferably 80 mass % or more.

The crystalline polyester resin may be synthesized by polycondensing (esterifying) the above polycarboxylic acid and polyhydric alcohol using a known esterification catalyst. The catalyst that may be used for synthesizing the crystalline polyester resin may be one kind or more, and examples thereof include alkali metal compounds such as sodium and lithium; compounds containing a Group 2 element such as magnesium and calcium; metal compounds such as aluminum, zinc, manganese, antimony, titanium, tin, zirconium, and germanium; phosphorous acid compounds; phosphoric acid compounds; and amine compounds.

Specifically, examples of the tin compound include dibutyltin oxide, tin octylate, tin dioctylate, and salts thereof. Examples of the titanium compound include titanium alkoxides such as tetranormal butyl titanate, tetraisopropyl titanate, tetramethyl titanate, and tetrastearyl titanate; titanium acylates such as polyhydroxytitanium stearate; and titanium chelates such as titanium tetraacetylacetonate, titanium lactate, titanium triethanol aminate. Examples of the germanium compound include germanium dioxide, and examples of the aluminum compound include oxides such as polyaluminum hydroxide, aluminum alkoxides, and tributylaluminate <Amorphous Polyester Resin>

The amorphous polyester resin is a polyester resin formed from a polyhydric alcohol and a polycarboxylic acid, and has no melting point and a glass transition temperature (Tg) when measured by differential scanning calorimetry (DSC).

The amorphous polyester resin is obtained by a polycondensation reaction between a di- or higher valent carboxylic acid (polycarboxylic acid) and a di- or higher valent alcohol (polyhydric alcohol). The specific amorphous polyester resin is not particularly limited, and an amorphous polyester resin known in the related art in the technological field may be used.

The specific method for producing the amorphous polyester resin is not particularly limited, and the amorphous polyester resin may be produced by polycondensing (esterifying) a polycarboxylic acid and a polyhydric alcohol using a known esterification catalyst.

The weight average molecular weight (Mw) of the amorphous polyester resin is not particularly limited, but is preferably, for example, in the range of 5000 to 100000, and more preferably in the range of 5000 to 50000. When the weight average molecular weight (Mw) is 5000 or more, the heat-resistant storability of the toner can be improved, and when Mw is 100000 or less, the anti-crease performance of the image can be further improved.

Examples of the polycarboxylic acid and polyhydric alcohol used for preparing the amorphous polyester resin include, but are not particularly limited to, the following.

(Polycarboxylic Acid)

Examples of the polycarboxylic acid include aromatic carboxylic acids such as terephthalic acid, isophthalic acid, phthalic anhydride, trimellitic anhydride, pyromellitic acid, and naphthalenedicalboxylic acid, aliphatic carboxylic acids such as maleic anhydride, fumaric acid, succinic acid, alkenyl succinic anhydride, and adipic acid, and alicyclic carboxylic acids such as cyclohexanedicarboxylic acid. These polycarboxylic acids may be used singly or in combinations of two or more. Among these polycarboxylic acids, it is preferable to use an aromatic carboxylic acid, and in order to secure better fixability, it is more preferable to use a tri- or higher valent carboxylic acid (such as trimellitic acid or an acid anhydride thereof) in combination with a dicarboxylic acid to form a crosslinked structure or a branched structure.

Examples of the tri- or higher valent carboxylic acid include 1,2,3-benzenetricarboxylic acid, 1,2,4-benzenetricarboxylic acid, 1,3,5-benzenetricarboxylic acid, 1,2,4-naphthalenetricarboxylic acid, and anhydrides and lower alkyl esters thereof. These may be used singly or in combinations of two or more.

(Polyhydric Alcohol)

Examples of the polyhydric alcohol include aliphatic diols such as ethylene glycol, diethylene glycol, triethylene glycol, propylene glycol, butanediol, hexanediol, neopentyl glycol, and glycerin, alicyclic diols such as cyclohexanediol, cyclohexanedimethanol, and hydrogenated bisphenol A, and aromatic diols such as an ethylene oxide adduct of bisphenol A and a propylene oxide adduct of bisphenol A. These polyhydric alcohols may be used singly or in combinations of two or more. Among these polyhydric alcohols, aromatic diols and alicyclic diols are preferable, and among them, aromatic diol is more preferable. In order to secure better fixability, a tri- or higher valent polyhydric alcohol (glycerin, trimethylolpropane, pentaerythritol) may be used in combination with a diol to form a crosslinked structure or a branched structure.

Also, the acid value of the polyester resin may be adjusted by further adding a monocarboxylic acid and/or a monoalcohol to the polyester resin obtained by polycondensation of a polycarboxylic acid and a polyhydric alcohol to esterify the hydroxy group and/or the carboxy group at the polymerization terminals.

Examples of the monocarboxylic acid include acetic acid, acetic anhydride, benzoic acid, trichloroacetic acid, trifluoroacetic acid, and propionic anhydride, and examples of the monoalcohol include methanol, ethanol, propanol, octanol, 2-ethylhexanol, trifluoroethanol, trichloroethanol, hexafluoroisopropanol, and phenol.

<Other Resins>

As the binder resin, in addition to the above-mentioned crystalline polyester resin and amorphous polyester resin, resins other than those may be used as long as the effects of the present invention are not impaired. Specifically, an amorphous vinyl resin may be contained in view of excellent charging characteristics and excellent toner transfer.

(Amorphous Vinyl Resin)

The vinyl resin that may be used for the present invention is not particularly limited as long as the vinyl resin is obtained by polymerizing a vinyl compound, and examples thereof include a (meth)acrylate resin, a styrene/(meth) acrylate resin, and an ethylene/vinyl acetate resin. These may be used singly or in combinations of two or more.

Among the above vinyl resins, the styrene/(meth)acrylate resin is preferred in consideration of plasticity during heat fixing.

Hereinafter, the styrene/(meth)acrylate resin (hereinafter, also referred to as "styrene/(meth)acrylic resin") as the amorphous resin will be described.

The styrene/(meth) acrylic resin is formed by addition polymerization of at least a styrene monomer and a (meth) acrylate monomer. The styrene monomer referred to herein includes, in addition to styrene represented by the rational formula of $CH_2{=}CH{-}C_6H_5$, those having a known side chain or functional group in the styrene structure.

The (meth)acrylate monomer referred to herein includes, in addition to acrylate represented by $CH_2{=}CHCOOR$ (R is an alkyl group) and methacrylate, esters having a known side chain or functional group in the structure of the acrylate derivative, the methacrylate derivative, or the like. In the present specification, the "(meth)acrylate monomer" is a generic term for "acrylate monomers" and "methacrylate monomers."

Examples of the styrene monomer and the (meth)acrylate monomer capable of forming a styrene/(meth)acrylic resin are shown below.

Examples of the styrene monomer include styrene, o-methylstyrene, m-methylstyrene, p-methylstyrene, α-methylstyrene, p-phenylstyrene, p-ethylstyrene, 2,4-dimethylstyrene, p-tert-butylstyrene, p-n-hexylstyrene, p-n-octylstyrene, p-n-nonylstyrene, p-n-decylstyrene, and p-n-dodecylstyrene. These styrene monomers may be used singly or in combinations of two or more.

Specific examples of the (meth)acrylate monomer include acrylate monomers such as methyl acrylate, ethyl acrylate, isopropyl acrylate, n-butyl acrylate, t-butyl acrylate, isobutyl acrylate, n-octyl acrylate, 2-ethylhexyl acrylate, stearyl acrylate, lauryl acrylate, and phenyl acrylate; and the methacrylate monomers such as methyl methacrylate, ethyl methacrylate, n-butyl methacrylate, isopropyl methacrylate, isobutyl methacrylate, t-butyl methacrylate, n-octyl methacrylate, 2-ethylhexyl methacrylate, stearyl methacrylate, lauryl methacrylate, phenyl methacrylate, diethylaminoethyl methacrylate, and dimethylaminoethyl methacrylate. These (meth)acrylate monomers may be used singly or in combinations of two or more.

The content of the structural units derived from the styrene monomer in the styrene/(meth)acrylic resin is preferably in the range of 40 to 80 mass % based on the total amount of the resin. Further, the content of the structural units derived from the (meth)acrylate monomer in the resin is preferably in the range of 10 to 60 mass % based on the total amount of the resin. Further, the styrene/(meth)acrylic resin may include the monomer compounds below in addition to the styrene monomer and the (meth)acrylate monomer. Examples of such monomer compounds include compounds having a carboxy group such as acrylic acid, methacrylic acid, maleic acid, itaconic acid, cinnamic acid, fumaric acid, monoalkyl maleate, and monoalkyl itaconate; and compounds having a hydroxy group such as 2-hydroxyethyl (meth)acrylate, 2-hydroxypropyl (meth)acrylate, 3-hydroxypropyl (meth)acrylate, 2-hydroxybutyl (meth)acrylate, 3-hydroxybutyl (meth)acrylate, and 4-hydroxybutyl (meth) acrylate. These monomer compounds may be used singly or in combinations of two or more.

The content of the structural units derived from the above monomer compounds in the styrene/(meth)acrylic resin is preferably in the range of 0.5 to 20 mass % based on the total amount of the resin.

The weight average molecular weight (Mw) of the styrene/(meth)acrylic resin is preferably in the range of 10000 to 100000.

A method for producing the styrene/(meth)acrylic resin is not particularly limited, and examples thereof include methods of performing known polymerization methods such as bulk polymerization, solution polymerization, emulsion polymerization method, miniemulsion method, dispersion polymerization method, using any typical polymerization initiator used for the polymerization of the above monomers, e.g. peroxides, persulfides, persulfates, and azo compounds. For the purpose of adjusting the molecular weight, a generally used chain transfer agent may be used. The chain transfer agent is not particularly limited, and examples thereof include alkyl mercaptans such as n-octyl mercaptan, and mercapto fatty acid esters.

(Measurement of Weight Average Molecular Weight (Mw) of Resin)

The weight average molecular weight (Mw) of the resin may be determined from the molecular weight distribution measured by gel permeation chromatography (GPC).

Specifically, a measurement sample is added to tetrahydrofuran (THF) so as to have a concentration of 1 mg/mL, and subjected to dispersion treatment at room temperature for 5 minutes using an ultrasonic disperser, followed by treatment with a membrane filter having a pore size of 0.2 μm to prepare the sample solution. Using a GPC apparatus HLC-8120GPC (manufactured by Tosoh Corporation) and a column TSKguard column and three TSKgel SuperHZ-M columns (manufactured by Tosoh Corporation), tetrahydrofuran is supplied at a flow rate of 0.2 mL/min as the carrier solvent while maintaining the column temperature at 40° C. Into the GPC apparatus, 10 μL of the prepared sample solution is injected together with the carrier solvent, and the sample is detected using a refractive index detector (RI detector), and the molecular weight distribution of the sample is calculated using the calibration curve measured using monodisperse polystyrene standard particles. The calibration curve is prepared by measuring ten polystyrene standard particles having molecular weights of $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$, and $4.48\times10^6$ (manufactured by Pressure Chemical).

[Colorant]

Known colorants may be used as the colorant according to the present invention.

Specifically, examples of the colorant contained in the yellow toner include C.I. Solvent Yellow 19, 44, 77, 79, 81, 82, 93, 98, 103, 104, 112, 162, and C.I. Pigment Yellow 14, 17, 74, 93, 94, 138, 155, 180, and 185. These may be used singly or in combinations of two or more.

Examples of the colorant contained in the magenta toner include C.I. Solvent Red 1, 49, 52, 58, 63, 111, and 122, and C.I. Pigment Red 5, 48:1, 53:1, 57:1, 122, 139, 144, 149, 166, 177, 178, and 222. These may be used singly or in combinations of two or more.

Examples of the colorant contained in the cyan toner include C.I. Pigment Blue 15:3.

Examples of the colorant contained in the black toner include carbon black, a magnetic material, and titanium black. Examples of the carbon black include channel black, furnace black, acetylene black, thermal black, and lamp black.

The content of the colorant is preferably in the range of 1 to 10 parts by mass based on 100 parts by mass of the binder resin.

[Release Agent]

Various known waxes may be used as the release agent. Examples of the wax include polyolefin waxes such as polyethylene wax and polypropylene wax, branched hydrocarbon waxes such as microcrystalline wax, long chain hydrocarbon waxes such as paraffin wax and sasol wax, dialkyl ketone waxes such as distearyl ketone wax, ester waxes such as carnauba wax, montan wax, behenyl behenate, trimethylolpropane tribehenate, pentaerythritol tetrabehenate, pentaerythritol diacetate dibehenate, glycerin tribehenate, 1,18-octadecanediol distearate, tristearyl trimellitate, distearyl maleate, and amide waxes such as ethylenediamine dibehenylamide and tristearylamide trimellitate.

The content of the release agent is preferably in the range of 0.1 to 30 parts by mass, and more preferably in the range of 1 to 10 parts by mass based on 100 parts by mass of the binder resin. These may be used singly or in combinations of two or more. Further, the melting point of the release agent is preferably in the range of 50 to 95° C. from the viewpoint of the low-temperature fixability and the releasability of the toner in electrophotography.

[Charge Control Agent]

The toner of the present invention may contain a charge control agent. The charge control agent to be used is not particularly limited as long as the charge control agent is a substance capable of providing a positive or negative charge by triboelectric charging and is colorless, and any known positively chargeable charge control agents and negatively chargeable charge control agents may be used.

The content ratio of the charge control agent is preferably in the range of 0.01 to 30 mass % in the toner, and more preferably in the range of 0.1 to 10 mass %.

«External Additives»

The external additive used in the present invention contains Al—Si composite oxide particles, and a Si element content of the Al—Si composite oxide particles is in the range of 50 to 90 mass % and a Si element ratio on surfaces of the Al—Si composite oxide particles is in the range of 3 to 35 at %.

The Al—Si composite oxide particles are metal oxide particles in which all or part of the Al element and the Si element are bonded via oxygen atoms. The Al—Si composite oxide particles are preferably formed of oxides of Al and Si.

When the Si element content is higher than 90 mass %, the volume resistance of the Al—Si composite oxide particles is too high, and thus image unevenness due to discharge caused by an increase in the transfer electric field under low-temperature and low-humidity occurs. When the Si element content is lower than 50 mass %, the Mohs hardness is too high, the Al—Si composite oxide particles are embedded in the toner, and thus the image density in a low printing mode decreases.

On the other hand, when the Si element ratio on the surfaces of the Al—Si composite oxide particles is less than 3 at %, the negative chargeability of the particle surface is low, and thus toner fogging in the non-printed portion under a high-temperature and high-humidity environment occurs. When the Si element ratio on the surfaces is higher than 35 at %, the negative charge on the particle surface is too high, and thus the image density under a low-temperature and low-humidity environment decreases.

[Measurement of Si Element Content of Composite Oxide Particles]

The Si element content of the composite oxide particles represents the Si element ratio (mass %) in the Al—Si composite oxide particles, and is determined using a fluorescent X-ray analyzer.

Specifically, the Si element content is determined by performing a qualitative analysis under the following analysis conditions using a fluorescent X-ray analyzer "XRF-1700" (manufactured by Shimadzu Corporation). For the measurement, the Kα peak angle of the element to be measured was determined from the 2θ table and used. With respect to the Al—Si composite oxide particles, the Si element content is determined by measuring the net intensity of Kα line for analysis of the Si element and the Al element using the following equation.

Si element content [mass %]=net intensity of Si element/(net intensity of Al element+net intensity of Si element)×100

(Analysis Conditions)

X-ray generator conditions/target material Rh, tube voltage 40 kV, tube current 95 mA, no filter Spectroscopy conditions/slit standard, no attenuator, spectroscopic crystals (Fe—LiF, Cl—Ge, Ca—LiF)

Detector (Fe—SC, Cl—FPC, Ca—FPC)

[Measurement of Si Element Ratio on Surface]

The Si element ratio on the surfaces of the Al—Si composite oxide particles refers to the Si element ratio on the surfaces of the particles as measured using the following X-ray photoelectron spectrometer under the conditions described below. The Si element ratio substantially corresponds the Si composition within the range from the outermost surface to a depth of 3 nm from the outermost surface. The Si element ratio of the Al—Si composite oxide particles is determined by performing quantitative analysis on the Al element and the Si element on the particle surface using an X-ray photoelectron spectrometer and calculating each atomic concentration (at %) on the particle surface using the relative sensitivity factor from the peak area of each element.

When the Al—Si composite oxide particles are subjected to a hydrophobic treatment, the Si element ratio is determined using the particles before the hydrophobic treatment.

Specifically, the Si element ratio is determined by performing the quantitative analysis using the X-ray photoelectron spectrometer "K-Alpha" (manufactured by Thermo Fisher Scientific) under the following analysis conditions and measuring the Si element concentration (hereinafter referred to as Si [at %]) and the Al element concentration (hereinafter referred to as Al [at %]) on the surface of the toner particles using the relative sensitivity factor calculated from the atomic peak area, using the following equations.

Si element ratio [at %] in surface composition=Si[at %]/(Si[at %]+Al[at %])×100

(Analysis Conditions)

X-ray: Al monochrome source

Acceleration: 12 kV, 6 mA

Resolution: 50 eV

Beam system: 400 μm

Pass energy: 50 eV

Step size: 0.1 eV

[Method for Producing Al—Si Composite Oxide Particles]

Examples of a method for producing the Al—Si composite oxide particles include a method in which silica or alumina is adhered to the surfaces of alumina particles or silica particles, respectively, to be coated therewith in an aqueous medium, a doping method, and a gas phase method. Among them, a production method in which particles are produced by a gas phase method and then a heat treatment is performed as a subsequent step is preferable.

An example thereof in which the production is performed by the gas phase method using a silicon tetrachloride gas and an aluminum trichloride gas will be described. First, a mixed gas having a predetermined ratio is prepared by mixing silicon tetrachloride gas, inert gas, hydrogen, and air. Similarly, a mixed gas is prepared by mixing aluminum trichloride gas, inert gas, hydrogen, and air. These two types of mixed gases are mixed or separately introduced into a reaction chamber and burned at a temperature of 1000° C. or more and 2500° C. or less to form Al—Si composite particles, which are collected by a filter after cooling.

In order to control the surface composition, it is preferable to prepare core-shell type Al—Si composite oxide particles including the above-prepared Al—Si composite oxide particles as a core and a shell layer further provided thereon.

In order to prepare the core-shell type Al—Si composite oxide particles, it is preferable to synthesize the shell layer by a liquid phase method in view of easily suppressing generation of secondary particles. In addition, in the synthesis by the liquid phase method, in order to suppress the generation of the secondary particles, it is preferable to reduce the reaction rate of the raw material, and specifically, it is preferable to reduce the amount of water added, which is the initiator, in a low-temperature environment.

The time-of-flight secondary ion mass spectrometry (TOF-SIMS) may be used to confirm whether core-shell type Al—Si composite oxide particles have been produced.

«Method for Producing Toner»

A method for producing the toner according to the present invention is not particularly limited, and a known method may be employed, but an emulsion polymerization aggregation method or an emulsion aggregation method may be suitably employed.

[Emulsion Polymerization Aggregation Method and Emulsion Aggregation Method]

The emulsion polymerization aggregation method preferably used in the method for producing a toner according to the present invention is a method for producing toner base particles by mixing a dispersion liquid of fine particles of a binder resin (hereinafter also referred to as "binder resin fine particles") produced by an emulsion polymerization method with a dispersion liquid of fine particles of a colorant (hereinafter, also referred to as "colorant fine particles") and a dispersion liquid of a release agent such as wax to cause aggregation until toner base particles reach a desired particle size, and fusing the binder resin fine particles to control the shape of the toner base particles.

The emulsion aggregation method preferably used in the method for producing a toner according to the present invention is a method for producing toner base particles by dropping a binder resin solution dissolved in a solvent into a poor solvent to obtain a resin particle dispersion liquid, mixing the resin particle dispersion liquid with a colorant dispersion liquid and a dispersion liquid of a release agent such as wax to cause aggregation until toner base particles reach a desired size, and fusing the binder resin fine particles to control the shape of the toner base particles.

The toner base particles having a core-shell structure may also be obtained by the emulsion polymerization aggregation method. Specifically, the toner base particles having a core-shell structure may be obtained by, first, aggregating, associating, and fusing binder resin fine particles for core particles and colorant particles to prepare core particles, and subsequently, adding binder resin fine particles for a shell layer to a dispersion liquid of the core particles to cause aggregation and fusion of the binder resin particles for a shell layer on the surfaces of the core particles so as to form a shell layer coating the surfaces of the core particles.

[External Additive Treatment]

The external additive mixing treatment with the external additive for the toner base particles may be performed using a mechanical mixing device. As the mechanical mixing device, a Henschel mixer, a Nauta mixer, a turbulent mixer, or the like may be used. Among these, a mixing device such as the Henschel mixer that can apply a shearing force to the particles to be processed may be used to increase the mixing time or increase the rotational circumferential speed of the stirring blade in the mixing treatment. When a plurality of types of external additives are used, all of the external additives may be mixed with the toner particles at a time, or may be divided and mixed a plurality of times depending on the external additives.

In the mixing method of the external additive, the degree of disintegration and the adhesive strength of the external additive may be controlled by controlling the strength of mixing, that is, the circumferential speed of the stirring blade, the mixing time, the mixing temperature, or the like by using the mechanical mixing device described above.

«Two-Component Developing Agent»

A two-component developing agent may be obtained by mixing the toner of the present invention with the following carrier particles. The mixing device used for the mixing is not particularly limited, and examples thereof include a Nauta mixer, a W-cone, and a V-type mixer.

The content of the toner (toner concentration) in the two-component developing agent is not particularly limited, but is preferably in the range of 4.0 to 8.0 mass %.

[Carrier Particles]

The carrier particles are made of a magnetic material, and known carrier particles may be used. Examples of the carrier particles include coated carrier particles each having a core particle made of a magnetic material and a coating material layer coating the surface of each core particle, and resin-dispersed carrier particles obtained by dispersing a fine powder of magnetic material in resin. The carrier particles are preferably the above-mentioned coated carrier particles from the viewpoint of suppressing adhesion of the carrier particles to the photoreceptor. Hereinafter, the coated carrier particles will be described.

The core particle included in the coated carrier particle (carrier core) is formed of a magnetic material, for example, a substance that is strongly magnetized by a magnetic field. Examples of the magnetic material include metals exhibiting ferromagnetism such as iron, nickel and cobalt, alloys or compounds containing these metals, and alloys exhibiting ferromagnetism by heat treatment. The above magnetic materials may be used singly or in combinations of two or more.

<Formation of Carrier Resin Coating Layer>

Specific examples of a method for preparing the coating layer include a wet coating method and a dry coating method. Although each method will be described below, the dry coating method is a particularly desirable method to be applied to the present invention, and will be described in detail below. The wet coating method includes the followings.

(1) Fluidized-Bed Spray Coating Method

A method of spray-coating a coating solution obtained by dissolving a coating resin in a solvent on surfaces of core particles using a fluidized bed, and then drying the coating solution to form a coating layer.

(2) Immersion Coating Method

A method of immersing core material particles in a coating solution obtained by dissolving a coating resin in a solvent to perform a coating treatment, and then drying the coating solution to form a coating layer.

(3) Polymerization Method

A method of immersing core material particles in a coating solution obtained by dissolving a reactive compound in a solvent to perform a coating treatment, and then applying heat or the like to cause a polymerization reaction so as to form a coating layer.

(Dry Coating Method)

A method of applying resin particles to surfaces of particles to be coated and then applying a mechanical impact force to melt or soften the resin particles applied to the surfaces of the particles to be coated and attach the resin particles to form a coating layer. Using a high-speed stirring mixer capable of applying a mechanical impact force to the carrier core material, resin, low-resistance fine particles, or the like without heating or under heating, high-speed stirring is performed to repeatedly apply the impact force to the mixture, and a carrier in which the resin and fine particles have been dissolved or softened and thus attached to the surface of the magnetic material particles is thereby produced. Regarding the coating conditions, when heated, the temperature is preferably in the range of 80 to 130° C., and the wind speed for generating the impact force is preferably 10 m/s or more during heating, and is preferably 5 m/s or less during cooling to suppress aggregation of carrier particles. The time for applying the impact force is preferably in the range of 20 to 60 minutes.

EXAMPLES

Hereinafter, the present invention will be described specifically with reference to Examples, but the present invention is not limited thereto. In the examples, the "parts" or "%" shown herein means "parts by mass" or "mass %" unless otherwise specified.

Example 1

«Preparation of Crystalline Polyester Resin Particle Dispersion Liquid (CP Dispersion Liquid)»

[Preparation of Crystalline Polyester Resin (CP Resin)]

1,10-Decanedicarboxylic acid: 50 parts by mol 1,6-Hexanediol: 50 parts by mol

The above monomers were placed in a reaction vessel equipped with a stirrer, a thermometer, a condenser, and a nitrogen gas introduction pipe, and the inside of the reaction vessel was replaced with dry nitrogen gas. Next, 0.4 parts by mass of titanium tetrabutoxide ($Ti(O\text{-}n\text{-}Bu)_4$) were added to 100 parts by mass in total of the above monomers. After stirring and reacting at 180° C. for 4 hours under a nitrogen gas stream, the temperature was further raised to 210° C. over 3 hours, the pressure in the reaction vessel was reduced to 3 kPa, and the mixture was stirred and reacted under reduced pressure for 2 hours, whereby a crystalline polyester resin (CP resin) was obtained.

The crystalline polyester resin (CP resin) had a weight average molecular weight (Mw) of 12000 and a melting point of 70° C.

[Preparation of Crystalline Polyester Resin Particle Dispersion Liquid (CP Dispersion Liquid]

Next, 200 parts by mass of the crystalline polyester resin and 200 parts by mass of methyl ethyl ketone were put into a separable flask, and the mixture was sufficiently mixed and dissolved at 70° C., and then 8 parts by mass of a 10 mass % aqueous ammonia solution was dropped thereinto. The heating temperature was lowered to 67° C., and ion-exchanged water was added dropwise with stirring at a liquid supply rate of 10 parts by mass/minute, and the addition of ion-exchanged water was stopped at the moment the amount of liquid supplied reached 800 parts by mass. Thereafter, the solvent was removed under reduced pressure. Further, pure water was added to adjust the resin solid content concentration to 20 mass %, whereby a crystalline polyester resin particle dispersion liquid (CP dispersion liquid) was obtained. The volume-based median diameter ($D_{50}$) of this dispersion liquid was 160 nm as measured by Microtrac UPA-150 (manufactured by Nikkiso Co., Ltd.).

«Preparation of Amorphous Polyester Resin Particle Dispersion Liquid (AP Dispersion Liquid)»

[Preparation of Amorphous Polyester Resin (AP Resin)]

Bisphenol A ethylene oxide 2.2 mol adduct: 40 parts by mol

Bisphenol A propylene oxide 2.2 mol adduct: 60 parts by mol

Terephthalic acid: 60 parts by mol

Fumaric acid: 15 parts by mol

Dodecenyl succinic acid: 20 parts by mol

Trimellitic acid: 5 parts by mol

Monomers other than trimellitic anhydride among the above monomers and 0.25 parts by mass of tin dioctylate per 100 parts by mass in total of the above monomers were added into a reaction vessel equipped with a stirrer, a thermometer, a condenser, and a nitrogen gas introduction pipe. After reacting at 235° C. for 3 hours under a nitrogen gas stream, the temperature was lowered to 200° C., trimellitic anhydride was added, and the reaction was carried out for 1 hour. The temperature was raised to 220° C. over 5 hours, and polymerized under a pressure of 10 kPa until a desired molecular weight was obtained, whereby a pale yellow transparent amorphous polyester resin (AP resin) was obtained.

The amorphous polyester resin (AP resin) had a weight average molecular weight (Mw) of 50000 and a glass transition temperature (Tg) of 56° C.

[Preparation of Amorphous Polyester Resin Particle Dispersion Liquid (AP Dispersion Liquid)]

Next, 200 parts by mass of an amorphous polyester resin (AP resin), 200 parts by mass of methyl ethyl ketone, and 7.0 parts by mass of a 10 mass % aqueous ammonia solution were placed in a separable flask, sufficiently mixed and dissolved, and then heated at 40° C. while heating and stirring, ion-exchanged water was dropped into the flask at 8 parts by mass/minute, and the dropping was stopped at the moment the amount of liquid supplied reached 580 parts by mass. Thereafter, the solvent was removed under reduced pressure. Further, pure water was added to adjust the resin solid content concentration to 20 mass %, whereby an amorphous polyester resin particle dispersion liquid (AP dispersion liquid) was obtained. The volume-based median diameter ($D_{50}$) of this dispersion liquid was 156 nm as measured by Microtrac UPA-150 (manufactured by Nikkiso Co., Ltd.).

«Preparation of Amorphous Vinyl Resin Particle Dispersion Liquid (AV Dispersion Liquid)»

In a reaction vessel equipped with a stirrer, a temperature sensor, a cooling pipe, and a nitrogen introduction device, 1.0 part by mass of an anionic surfactant (Dowfax manufactured by Dow Chemical Company) and 1500 parts by mass of ion-exchanged water were placed, and the internal temperature was raised to 75° C. while stirring under a nitrogen stream.

Next, a solution obtained by dissolving 9.0 parts by mass of sodium peroxodisulfate (KPS) in 160 parts by mass of ion-exchanged water was added into the solution, and the liquid temperature was adjusted to 75° C. Further, a monomer mixture comprising 300 parts by mass of styrene (St) monomer, 95 parts by mass of n-butyl acrylate (BA) monomer, 20 parts by mass of methacrylic acid (MAA) monomer and 4 parts by mass of tert-dodecyl mercaptan was dropped thereto over 2 hours.

After completion of the dropwise addition, the mixture was polymerized by heating and stirring at 75° C. for 2 hours, whereby an amorphous vinyl resin particle dispersion liquid (AV dispersion liquid) having a resin solid content of 20 mass % was obtained. The volume-based median diameter ($D_{50}$) of this dispersion liquid was 155 nm as measured by Microtrac UPA-150 (manufactured by Nikkiso Co., Ltd.).

The amorphous vinyl resin (AV resin) in the amorphous vinyl resin particle dispersion liquid (AV dispersion liquid) had a glass transition temperature (Tg) of 52° C. and a weight average molecular weight (Mw) of 45000.

«Preparation of Release Agent Particle Dispersion Liquid»

Paraffin wax (HNP51, manufactured by Nippon Seiro Co. Ltd., melting point 77° C.): 200 parts by mass Sodium dodecyl sulfate: 20 parts by mass Ion-exchanged water: 1780 parts by mass The solution obtained by mixing the above components was heated to 95° C. and sufficiently dispersed by ULTRA TURRAX T50 (manufactured by IKA), and then subjected to dispersion treatment with a pressure discharge type Gaulin homogenizer, whereby a release agent particle dispersion liquid was obtained.

The volume average particle size of the particles in the release agent particle dispersion liquid was 225 nm as measured by Microtrac UPA-150 (manufactured by Nikkiso Co., Ltd.).

«Preparation of Colorant Particle Dispersion Liquid»

[Preparation of Black Colorant Particle Dispersion Liquid]

Carbon black (REGAL (R) 330, manufactured by Cabot Corporation): 100 parts by mass Sodium dodecyl sulfate: 15 parts by mass Ion-exchanged water: 885 parts by mass The above components were mixed and sufficiently dispersed by ULTRA TURRAX T50 (manufactured by IKA), the mixture was treated with an ultrasonic disperser for 20 minutes, whereby a black colorant particle dispersion liquid was obtained. The volume-based median diameter ($D_{50}$) of the colorant particles in the dispersion liquid was 150 nm as measured using Microtrac UPA-150 (manufactured by Nikkiso Co., Ltd.).

«Preparation of Toner Base Particles»

[Preparation of Toner Base Particles]

<Aggregation/Fusion Step and Aging Step>

Crystalline polyester resin particle dispersion liquid (CP dispersion liquid): 75 parts by mass Amorphous polyester resin particle dispersion liquid (AP dispersion liquid): 625 parts by mass Amorphous vinyl resin particle dispersion liquid (AV dispersion liquid): 1800 parts by mass Release agent particle dispersion liquid: 500 parts by mass Black colorant particle dispersion liquid: 400 parts by mass Anionic surfactant (Dowfax2A1 20% aqueous solution): 40 parts by mass Ion-exchanged water: 3000 parts by mass The above materials were placed in a reaction vessel equipped with a thermometer, a pH meter and a stirrer, and the pH was adjusted to 3.0 by adding 1.0% nitric acid at a temperature of 25° C. Thereafter, 100 parts by mass of a 2% aqueous solution of aluminum sulfate (aggregating agent) was added and dispersed over 30 minutes at 3000 rpm with a homogenizer (ULTRA TURRAX T50 manufactured by IKA). After the completion of the dropwise addition, the mixture was stirred for 10 minutes to sufficiently mix the raw materials and the aggregating agent.

Thereafter, a stirrer and a mantle heater were installed in the reaction vessel, and the rotation speed of the stirrer was adjusted so that the slurry was sufficiently stirred, and the temperature was raised at a heating rate of 0.2° C./min up to a temperature of 40° C., and at a heating rate of 0.05° C./min after exceeding 40° C., and the particle size was measured every 10 minutes using Coulter Multisizer 3 (aperture diameter 100 μm, manufactured by Beckman Coulter, Inc.). At the moment the volume-based median diameter reached 5.5 μm, the materials were mixed in advance whiling maintaining the temperature steady.

Next, the mixture was held at 50° C. for 30 minutes, 8 parts of a 20% EDTA (ethylenediaminetetraacetic acid) solution was added to the reaction vessel, and then a 1 mol/L aqueous sodium hydroxide solution was added to adjust the pH of the raw material dispersion liquid to 9.0. Thereafter, while adjusting the pH to 9.0 every 5° C., the temperature was raised to 85° C. at a heating rate of 1° C./min and maintained at 85° C.

<Cooling Step>

Thereafter, at the moment the average circularity reached 0.971 as measured using "FPIA-3000," the mixture was cooled at a cooling rate of 10° C./min, whereby a toner base particle dispersion liquid (1) was obtained.

<Filtration/Washing Step and Drying Step>

Thereafter, the mixture was filtered and sufficiently washed with ion-exchanged water. Next, the resultant was dried at 40° C. to obtain toner base particles (1). The toner base particles (1) thus obtained had a volume-based median diameter of 4.0 μm and an average circularity of 0.971.

«Preparation of Toner Particles»

[Preparation of Al—Si Composite Oxide Particles (1)]

Evaporation was performed in an evaporator at 175 kg/hr of silicon tetrachloride ($SiCl_4$) and 125 kg/hr of aluminum trichloride ($AlCl_3$) and at approximately 200° C., and the chloride vapor was passed with nitrogen into the mixing chamber of the burner. Here, the gas flow was mixed with 100 $Nm^3$/hr of hydrogen and 450 $Nm^3$/hr of air, and was supplied to the flame through the central tube (diameter 7 mm). Consequently, the gas flow was supplied at the burner temperature of 230° C. and at the discharge rate from the tube of approximately 35.8 m/s. Through the outer tube, 0.05 $Nm^3$/hr of hydrogen was supplied as a jacket-type gas. The gas was burned in the reaction chamber and cooled to approximately 110° C. in the downstream aggregation zone. The primary particles of the Al—Si composite oxide core particles were aggregated, and the Al—Si composite oxide core particles thus obtained were separated and recovered in a cyclone from the hydrochloric acid-containing gas generated at the same time, and the powder including moist air was treated at approximately 500 to 700° C., whereby the Al—Si composite oxide particles were obtained.

Using the Al—Si composite oxide particles thus obtained as a core, the Al—Si composite oxide was further shelled. Specifically, a solution obtained by diluting 9.7 parts by mass of aluminum isopropoxide and 0.5 parts by mass of tetraethyl orthosilicate with 500 parts by mass of ethanol was added to 95 parts by mass of the Al—Si composite oxide particles while stirring in a nitrogen atmosphere at 5° C., and 50 parts by mass of water were added, stirred for 120 minutes, dried under reduced pressure, and then further calcinated at 700° C. for 3 hours, whereby Al—Si composite oxide particles (1) were obtained.

As a result of measurement by the method described above, the Si element ratio in the surface composition of the Al—Si composite oxide particles (1) thus obtained was found to be 3 at %, and the Si element content was found to be 50 mass %.

[Preparation of Al—Si Composite Oxide Particles (2) to (16)]

In the preparation of the Al—Si composite oxide particles (1), silicon tetrachloride, aluminum trichloride, aluminum isopropoxide and tetraethyl orthosilicate were changed as shown in Table I below to obtain Al—Si composite oxide particles (2) to (16).

As a result of the measurement by the method described above, the Si element ratios in the surface compositions and the Si element contents of the Al—Si composite oxide particles (2) to (16) thus obtained were as shown Table I.

TABLE I

| | Materials | | | | Composition | |
|---|---|---|---|---|---|---|
| Al—Si composite oxide particles No. | Silicon tetrachloride [kg/h] | Aluminum trichloride [kg/h] | Tetraethyl orthosilicate [parts by mass] | Aluminum propoxide [parts by mass] | Si element ratio on surface [at %] | Si element content [mass %] |
| 1 | 175 | 125 | 0.5 | 9.7 | 3 | 50 |
| 2 | 170 | 130 | 6.2 | 6.4 | 35 | 50 |
| 3 | 287 | 13 | 0.5 | 9.7 | 3 | 90 |
| 4 | 283 | 17 | 6.2 | 6.4 | 35 | 90 |
| 5 | 175 | 125 | 0.9 | 9.5 | 5 | 50 |

TABLE I-continued

| Al—Si composite oxide particles No. | Materials: Silicon tetrachloride [kg/h] | Aluminum trichloride [kg/h] | Tetraethyl orthosilicate [parts by mass] | Aluminum propoxide [parts by mass] | Composition: Si element ratio on surface [at %] | Si element content [mass %] |
|---|---|---|---|---|---|---|
| 6 | 173 | 127 | 2.7 | 8.5 | 15 | 50 |
| 7 | 205 | 95 | 0.9 | 9.5 | 5 | 60 |
| 8 | 261 | 39 | 0.9 | 9.5 | 5 | 80 |
| 9 | 176 | 124 | 0.2 | 9.9 | 1 | 50 |
| 10 | 169 | 131 | 7.1 | 5.9 | 40 | 50 |
| 11 | 287 | 13 | 0.2 | 9.9 | 1 | 90 |
| 12 | 282 | 18 | 7.1 | 5.9 | 40 | 90 |
| 13 | 144 | 156 | 0.5 | 9.7 | 3 | 40 |
| 14 | 292 | 8 | 0.5 | 9.7 | 3 | 92 |
| 15 | 138 | 162 | 6.2 | 6.4 | 35 | 40 |
| 16 | 288 | 12 | 6.2 | 6.4 | 35 | 92 |

«Preparation of Toner»

[Preparation of Toner (1) (External Additive Treatment Step)]

To 100 parts by mass of the toner base particles, 2 parts by mass of the Al—Si composite oxide particles (1) were added to a Henschel mixer type "FM20C/I" (manufactured by Nippon Coke Industry Co., Ltd.), and stirring was performed for 15 minutes at a rotation speed of the stirring blade such that the circumferential speed of the blade tip becomes 40 m/s, whereby a toner (1) was prepared.

The temperature during mixing the Al—Si composite oxide particles (1) with the toner base particles was controlled to be 40° C.±2° C.

<Production of Developing Agent (1)>

(Production of Resin for Coating Core Material)

To a 0.3 mass % aqueous solution of sodium benzenesulfonate, cyclohexyl methacrylate and methyl methacrylate were added at a molar ratio of 1:1 and potassium persulfate in an amount corresponding to 0.5 mass % of the total amount of monomers were added to perform emulsion polymerization. The resin particles in the dispersion liquid thus obtained were dried by spray-drying the dispersion liquid, whereby a coating material which is the resin for coating the core material was prepared. The weight average molecular weight (Mw) of the coating material thus obtained was 500000. The weight average molecular weight (Mw) of the coating material was determined by gel permeation chromatography (GPC).

(Preparation of Carrier Particles)

Mn—Mg based ferrite particles having a volume average size of 25 μm were prepared as core material particles. In a high-speed stirring mixer equipped with a horizontal stirring blade, 100 parts by mass of the ferrite particles and 4.5 parts by mass of the coating material were placed, and the mixture was stirred at 22° C. for 15 minutes under the condition that the circumferential speed of the horizontal rotating blade became 8 m/sec. Thereafter, the mixture was mixed at 120° C. for 50 minutes, and the surfaces of the core material particles were coated with the coating material by the action of a mechanical impact force (mechanochemical method), whereby carrier particles were prepared. The median diameter based on the volume distribution of the carrier particles was 28 μm.

(Measurement of Volume-Based Median Diameter of Carrier Particles)

The volume-based median diameter of the magnetic material particles is measured by a laser diffraction particle size distribution analyzer "HELOS KA" (manufactured by Nippon Laser Co., Ltd.) by a wet method.

Specifically, first, an optical system having a focal position of 200 mm was selected, and the measurement time was set to 5 seconds. Then, the magnetic material particles for measurement were added to a 0.2% aqueous solution of sodium dodecyl sulfate, and dispersed for 3 minutes using an ultrasonic cleaner "US-1" (manufactured by AS ONE Corporation) to prepare a sample dispersion liquid for measurement. Then, several drops of the sample dispersion liquid were supplied to "HELOS KA," and the measurement started at the moment the sample concentration gauge reached the measurable area. Based on the particle size distribution thus obtained, a cumulative distribution was created from the smaller diameter side with respect to the particle size range (channel), and the particle size at which the cumulative value became 50% was defined as the volume-based median diameter.

(Preparation of Developing Agent (1))

The toner (1) and the carrier particles were adjusted such the content of the toner (toner concentration) in a two-component developing agent was 7 mass %, and were mixed with a V-type mixer for 30 minutes, whereby a developing agent (1), which is a two-component developing agent, was prepared.

[Preparation of Toners (2) to (24) and Developing Agents (2) to (24)]

In the preparation of the toner (1), the binder resin and the Al—Si composite oxide particles in the toner base particles were changed as shown in Table II below to prepare toners (2) to (24). Further, in the preparation of the developing agent (1), the developing agents (2) to (24) were prepared by changing the toner (1) as shown in Table II.

TABLE II

| | | Binder resin | | | | Al—Si composite oxide particles | | | |
|---|---|---|---|---|---|---|---|---|---|
| Developing agent No. | Toner No. | No. | Crystalline polyester resin content [mass %] | Amorphous polyester resin content [mass %] | Amorphous vinyl resin content [mass %] | No. | Si element ratio on particle surface [at %] | Si element content [mass %] | Remarks |
| 1 | 1 | 1 | 3 | 25 | 72 | 1 | 3 | 50 | Present Invention |
| 2 | 2 | 1 | 3 | 25 | 72 | 2 | 35 | 50 | Present Invention |
| 3 | 3 | 1 | 3 | 25 | 72 | 3 | 3 | 90 | Present Invention |
| 4 | 4 | 1 | 3 | 25 | 72 | 4 | 35 | 90 | Present Invention |
| 5 | 5 | 1 | 3 | 25 | 72 | 5 | 5 | 50 | Present Invention |
| 6 | 6 | 1 | 3 | 25 | 72 | 6 | 15 | 50 | Present Invention |
| 7 | 7 | 1 | 3 | 25 | 72 | 7 | 5 | 60 | Present Invention |
| 8 | 8 | 1 | 3 | 25 | 72 | 8 | 5 | 80 | Present Invention |
| 9 | 9 | 2 | 5 | 25 | 70 | 7 | 5 | 60 | Present Invention |
| 10 | 10 | 3 | 20 | 25 | 55 | 7 | 5 | 60 | Present Invention |
| 11 | 11 | 4 | 25 | 25 | 50 | 7 | 5 | 60 | Present Invention |
| 12 | 12 | 5 | 5 | 30 | 65 | 7 | 5 | 60 | Present Invention |
| 13 | 13 | 6 | 5 | 80 | 15 | 7 | 5 | 60 | Present Invention |
| 14 | 14 | 7 | 5 | 85 | 10 | 7 | 5 | 60 | Present Invention |
| 15 | 15 | 1 | 3 | 25 | 72 | 9 | 1 | 50 | Comparative Example |
| 16 | 16 | 1 | 3 | 25 | 72 | 10 | 40 | 50 | Comparative Example |
| 17 | 17 | 1 | 3 | 25 | 72 | 11 | 1 | 90 | Comparative Example |
| 18 | 18 | 1 | 3 | 25 | 72 | 12 | 40 | 90 | Comparative Example |
| 19 | 19 | 1 | 3 | 25 | 72 | 13 | 3 | 40 | Comparative Example |
| 20 | 20 | 1 | 3 | 25 | 72 | 14 | 3 | 92 | Comparative Example |
| 21 | 21 | 1 | 3 | 25 | 72 | 15 | 35 | 40 | Comparative Example |
| 22 | 22 | 1 | 3 | 25 | 72 | 16 | 35 | 92 | Comparative Example |
| 23 | 23 | 8 | 0 | 25 | 75 | 1 | 3 | 50 | Comparative Example |
| 24 | 24 | 9 | 3 | 0 | 97 | 1 | 3 | 50 | Comparative Example |

«Evaluation»

[Evaluation of Minimum Fixing Temperature]

Each of the developing agents prepared above was loaded into a copying machine "bizhub PRESS C1070" (manufactured by Konica Minolta) including a fixing device modified such that the surface temperature of the heating roller (fixing temperature) can be changed in the range of 130 to 200° C., and the evaluation was performed.

First, in an environment of normal-temperature and normal-humidity (temperature: 20° C., humidity: 50% RH), the adhesion mass of the toner image was set to 4.0 g/m$^2$ on A4-size high-quality paper "CF paper" (manufactured by Konica Minolta). Thereafter, a fixing experiment for fixing a four-color image having a size of 100 mm×100 mm was repeated up to 200° C. while changing the set fixing temperature from 130° C. in steps of 1° C.

The printed material obtained at each fixing temperature obtained above was visually checked, and the minimum temperature at which the toner did not left on and adhere to the fixing device and was entirely fixed on the paper was defined as the minimum fixing temperature (° C.). Those having a minimum fixing temperature of 139° C. or lower were rated as excellent, those of 140° C. or higher and 150° C. or lower as good, and those of 151° C. or higher as fail.

[Evaluation of Anti-Crease Performance of Toner-Fixed Image]

Each of the developing agents prepared above was loaded into a copying machine "bizhub PRESS C1070" (manufactured by Konica Minolta) including a fixing device modified such that the surface temperature of the heating roller (fixing temperature) was allowed to be changed in the range of 130 to 200° C., and used.

A fixing experiment for fixing a solid image having a toner adhesion mass of 11 g/m$^2$ on A4-size high-quality paper "CF paper" (manufactured by Konica Minolta) in an environment of normal-temperature and normal-humidity (temperature: 20° C., humidity: 50% RH) was repeated up to 200° C. while changing the set fixing temperature from 120° C. in steps of 1° C.

Nine reflection densities were measured for the print materials obtained at the respective fixing temperatures obtained above, and the average value was defined as [D1]. The reflection densities were measured using a spectrophotometer "Gretag Macbeth Spectrolino" (manufactured by Gretag Macbeth). The measurement was performed using a D65 light source as the light source and a ϕ4 mm reflection measurement aperture, at measuring wavelengths of 380 to 730 nm at 10 nm intervals and a viewing angle (observer) of 2°, and using a special white tile as a reference.

Thereafter, the solid image was quickly creased by applying a load of 300 kPa to the solid image using a creaser, and 0.35 MPa compressed air was ejected from a nozzle having a diameter of 2 mm from a distance of 1 cm from the image and sprayed on the image crease. Nine reflection densities were measured at the portion where the compressed air was blown, and the average value was defined as [D2].

[D2]/[D1] was calculated for the printed material at each fixing temperature, and the temperature at which [D2]/[D1] exceeds 0.90 for the first time was determined as the pass temperature [T1] of the anti-crease performance. Those with [T1] of 159° C. or lower were rated as excellent, those of 160° C. or higher and 180° C. or lower as good, and those of 181° C. or higher as fail.

[Fogging Evaluation Under High-Temperature and High-Humidity Environment]

Each of the developing agents prepared above was loaded into a copying machine "bizhub PRESS C1070" (manufactured by Konica Minolta), and the evaluation was performed.

First, using a developing agent left for 24 hours under a high-temperature and high-humidity environment (temperature 30° C., humidity 80% RH), A3-size high-quality paper "CF paper" (manufactured by Konica Minolta) was passed under a condition of 0% printing rate in a high-temperature and high-humidity environment, whereby a white paper was obtained. The image densities of 20 places on the white paper thus obtained were measured using a densitometer "FD-7" (manufactured by Konica Minolta), and the average value was obtained as the white paper density. Those with the obtained white paper density of 0.003 or less were rated as excellent, those of 0.004 or more and 0.006 or less as good, those of 0.007 or more and 0.010 or less as acceptable, and those of 0.011 or more as fail.

[Evaluation of Image Density Under Low-Temperature and Low-Humidity Environment]

Each of the developing agents prepared above was loaded into a copying machine "bizhub PRESS C1070" (manufactured by Konica Minolta) in which the control of temperature and humidity correction were disabled, and the evaluation was performed.

First, in an environment of normal-temperature and normal-humidity (temperature: 20° C., humidity: 50% RH), the adhesion mass of the toner image was set to 4.0 g/m$^2$ on A4-size high-quality paper "CF paper" (manufactured by Konica Minolta).

Thereafter, in an environment of low-temperature and low-humidity (temperature of 10° C., humidity of 20% RH), a 100 mm×100 mm size image was output on A4-size high-quality paper "CF paper."

The reflection density of the image thus obtained under a low-temperature and low-humidity environment was measured using a densitometer FD7 (manufactured by Konica Minolta). Those with the measured image density of 1.31 or more were rated as excellent, those of 1.20 or more and 1.30 or less as good, those of 1.10 or more and 1.19 or less as acceptable, and those of less than 1.10 as fail.

[Evaluation of In-Plane Uniformity of Image Under Low-Temperature and Low-Humidity Environment]

Each of the developing agents prepared above was loaded into a copying machine "bizhub PRESS C1070" (manufactured by Konica Minolta), and the evaluation was performed.

First, using a developing agent left for 24 hours in a low-temperature and low-humidity (temperature 10° C., humidity 20% RH) environment, an image at a printing rate of 100% was output on A3-size high-quality paper "CF paper" (manufactured by Konica Minolta) under a low-temperature and low-humidity environment. The density unevenness in the image thus obtained was visually evaluated, and the in-plane uniformity was ranked as follows: rank 4 as excellent; rank 3 or less as good; rank 2 as acceptable; and rank 1 as fail.

Rank 4: No density unevenness is observed

Rank 3: Slight density unevenness is partially observed

Rank 2: Density unevenness is partially observed

Rank 1: Density unevenness is observed on the entire surface of the image

[Evaluation of Image Density in Low Printing Mode]

Each of the developing agents prepared above was loaded into a copying machine "bizhub PRESS C1070" (manufactured by Konica Minolta), and the evaluation was performed.

First, in an environment of normal-temperature and normal-humidity (temperature: 20° C., humidity: 50% RH), one sheet of a whole solid image was output on A3-size high-quality paper "CF paper" (manufactured by Konica Minolta), and the image densities of 9 points thereon were measured using a densitometer "FD-7" (manufactured by Konica Minolta), and the average was obtained as the image density [D1].

Further, after passing 10000 sheets under the condition of a printing rate of 0%, one sheet of a whole solid image was output to A3-size high-quality paper "CF paper" (manufactured by Konica Minolta), and the average of 9 points was obtained as the image density [D2]. Those with [D2]/[D1] of 0.90 or more were rated as excellent, those of 0.80 or more and 0.89 or less as good, those of 0.70 or more and 0.79 or less as acceptable, and those of 0.69 or less as fail.

The results are shown in Table III.

TABLE III

| Developing agent No. | Toner No. | Evaluation: Minimum fixing temperature [° C.] | Anti-crease performance of the toner image [T1: ° C.] | Fogging under high-temperature and high-humidity | Image density evaluation under low-temperature and low-humidity | Rank of in-plane uniformity of image density under low-temperature and low-humidity environment | Image density evaluation in low printing mode | Remarks |
|---|---|---|---|---|---|---|---|---|
| 1 | 1 | 146 | 165 | 0.007 | 1.33 | 4 | 0.76 | Present Invention |
| 2 | 2 | 144 | 167 | 0.003 | 1.16 | 4 | 0.73 | Present Invention |
| 3 | 3 | 148 | 168 | 0.008 | 1.31 | 2 | 0.93 | Present Invention |
| 4 | 4 | 142 | 164 | 0.003 | 1.13 | 2 | 0.93 | Present Invention |
| 5 | 5 | 144 | 161 | 0.004 | 1.23 | 4 | 0.75 | Present Invention |
| 6 | 6 | 143 | 168 | 0.004 | 1.25 | 4 | 0.72 | Present Invention |
| 7 | 7 | 145 | 164 | 0.006 | 1.22 | 3 | 0.83 | Present Invention |
| 8 | 8 | 146 | 164 | 0.004 | 1.27 | 3 | 0.88 | Present Invention |
| 9 | 9 | 138 | 165 | 0.005 | 1.28 | 3 | 0.84 | Present Invention |
| 10 | 10 | 135 | 163 | 0.005 | 1.27 | 3 | 0.82 | Present Invention |
| 11 | 11 | 132 | 161 | 0.006 | 1.22 | 3 | 0.78 | Present Invention |
| 12 | 12 | 139 | 158 | 0.006 | 1.24 | 3 | 0.85 | Present Invention |
| 13 | 13 | 138 | 153 | 0.004 | 1.26 | 3 | 0.83 | Present Invention |
| 14 | 14 | 136 | 153 | 0.005 | 1.15 | 3 | 0.85 | Present Invention |
| 15 | 15 | 143 | 165 | 0.012 | 1.35 | 4 | 0.78 | Comparative Example |
| 16 | 16 | 141 | 162 | 0.002 | 1.06 | 4 | 0.75 | Comparative Example |
| 17 | 17 | 140 | 165 | 0.014 | 1.32 | 2 | 0.94 | Comparative Example |
| 18 | 18 | 142 | 162 | 0.002 | 1.07 | 2 | 0.95 | Comparative Example |
| 19 | 19 | 145 | 168 | 0.008 | 1.34 | 4 | 0.66 | Comparative Example |
| 20 | 20 | 147 | 166 | 0.007 | 1.33 | 1 | 0.98 | Comparative Example |
| 21 | 21 | 145 | 165 | 0.003 | 1.15 | 4 | 0.67 | Comparative Example |
| 22 | 22 | 146 | 163 | 0.001 | 1.17 | 1 | 0.97 | Comparative Example |
| 23 | 23 | 152 | 168 | 0.010 | 1.36 | 4 | 0.72 | Comparative Example |
| 24 | 24 | 145 | 184 | 0.009 | 1.34 | 4 | 0.77 | Comparative Example |

Table III indicates the following.

It is presumed that when the Si element ratio on the surface of the external additive is less than 3%, the negative chargeability of the particle surface is low, and toner fogging thus occurs in a non-printed portion under a high-temperature and high-humidity environment, and it is presumed that when the Si element ratio on the surface composition is higher than 35%, the negative charge on the particle surface becomes too high, and the image density under a low-temperature and low-humidity environment thus decreases.

Further, it is presumed that when the content ratio of the Si element in the external additive is higher than 90 mass %, the volume resistance of the Al—Si composite oxide particles becomes high and discharge occurs due to high transfer electric field under low-temperature and low-humidity, and the image unevenness thus occurs, and it is presumed that when the Si element content ratio is lower than 50 mass %, Mohs hardness becomes too high and embedding of the Al—Si composite oxide particles in the toner proceeds, and the image density in the low printing mode thus decreases.

Further, it is presumed that when the content of the amorphous polyester resin is 30 mass % or more, the internal cohesion of the resin is sufficiently obtained, and the anti-crease performance of the toner image after fixing thus becomes better, and it is presumed that when the content of the amorphous polyester resin is 80 mass % or less, the polarity of the resin does not become too high and the excessive charging of toner is appropriately adjusted under low-temperature and low-humidity, and the decrease in image density under low-temperature and low-humidity is thus further suppressed.

Although embodiments of the present invention have been described and illustrated in detail, the disclosed embodiments are made for purposes of illustration and example only and not limitation. The scope of the present invention should be interpreted by terms of the appended claims.

What is claimed is:

1. A toner for electrostatic charge image development comprising toner particles containing a binder resin and an external additive, wherein the binder resin contains a crystalline polyester resin and an amorphous polyester resin, the external additive includes Al—Si composite oxide particles, and a Si element content of the Al—Si composite oxide particles is in the range of 50 to 90 mass % and a Si element ratio on surfaces of the Al—Si composite oxide particles is in the range of 3 to 35 at %.

2. The toner for electrostatic charge image development according to claim 1, wherein the Si element ratio on the surfaces of the Al—Si composite oxide particles is in the range of 5 to 15 at %.

3. The toner for electrostatic charge image development according to claim 1, wherein the Si element content of the Al—Si composite oxide particles is in the range of 60 to 80 mass %.

4. The toner for electrostatic charge image development according to claim 1, wherein a content of the crystalline polyester resin in the binder resin is in the range of 5 to 20 mass %.

5. The toner for electrostatic charge image development according to claim 1, wherein a content of the amorphous polyester resin in the binder resin is in the range of 30 to 80 mass %.

6. The toner for electrostatic charge image development according to claim 1, wherein the Al—Si composite oxide particles are core-shell type particles each having a core and a shell layer on the core, the core and the shell layer are formed from an Al—Si composite oxide, and a ratio of Si and Al of the core is different from a ratio of Si and Al of the shell layer.

* * * * *